US008011147B2

(12) United States Patent
Hanlan

(10) Patent No.: US 8,011,147 B2
(45) Date of Patent: Sep. 6, 2011

(54) BUILDING SYSTEM USING MODULAR PRECAST CONCRETE COMPONENTS

(76) Inventor: John W. Hanlan, Littleton, CO (US)

( * ) Notice: Subject to any disclaimer, the term of this patent is extended or adjusted under 35 U.S.C. 154(b) by 10 days.

(21) Appl. No.: 11/742,030

(22) Filed: Apr. 30, 2007

(65) Prior Publication Data

US 2008/0060293 A1 Mar. 13, 2008

Related U.S. Application Data

(60) Provisional application No. 60/843,799, filed on Sep. 11, 2006.

(51) Int. Cl.
*E04B 1/00* (2006.01)

(52) U.S. Cl. ..... 52/252; 52/236.3; 52/283

(58) Field of Classification Search ..... 52/252, 52/260, 236.3, 236.5, 263, 322, 262, 283, 52/253

See application file for complete search history.

(56) References Cited

U.S. PATENT DOCUMENTS

| | | | | | |
|---|---|---|---|---|---|
| 915,421 | A | * | 3/1909 | Eisen | 52/236.9 |
| 938,458 | A | * | 11/1909 | Brockhausen | 52/283 |
| 980,480 | A | * | 1/1911 | Bishop | 52/745.17 |
| 1,031,047 | A | * | 7/1912 | Conzelman | 52/259 |
| 1,205,465 | A | * | 11/1916 | Maguire et al. | 52/252 |
| 1,354,560 | A | * | 10/1920 | Hutchinson | 52/777 |
| 1,407,277 | A | * | 2/1922 | Ingberg | 403/173 |
| 1,510,234 | A | * | 9/1924 | Mann | 52/283 |
| 1,516,074 | A | * | 11/1924 | Borg | 52/236.9 |
| 2,970,676 | A | * | 2/1961 | Maciunas | 52/207 |
| 3,378,971 | A | * | 4/1968 | Singer et al. | 52/263 |
| 3,429,092 | A | * | 2/1969 | Hart et al. | 52/653.1 |
| 3,473,273 | A | * | 10/1969 | Gunkel | 52/79.1 |
| 3,495,371 | A | * | 2/1970 | Mitchell, Jr. | 52/653.1 |
| 3,513,610 | A | * | 5/1970 | Devonport | 52/283 |
| 3,604,177 | A | * | 9/1971 | Clyne et al. | 52/283 |
| 3,693,929 | A | * | 9/1972 | Martin | 249/25 |
| 3,708,933 | A | * | 1/1973 | Yang | 52/236.4 |
| 3,713,265 | A | | 1/1973 | Wysocki et al. | |
| 3,733,757 | A | * | 5/1973 | Scott | 52/105 |
| 3,745,731 | A | * | 7/1973 | Simpson et al. | 52/236.6 |
| 3,780,480 | A | | 12/1973 | Cvijanovic et al. | |
| 3,813,835 | A | * | 6/1974 | Rice | 52/223.7 |
| 3,897,663 | A | * | 8/1975 | Gaul | 52/136 |
| 3,918,222 | A | * | 11/1975 | Bahramian | 52/223.7 |
| 4,302,915 | A | * | 12/1981 | Stocks | 52/175 |
| 4,341,051 | A | | 7/1982 | Sim et al. | |
| 4,505,087 | A | * | 3/1985 | Sarda | 52/745.05 |
| 4,646,495 | A | | 3/1987 | Chalik | |
| 4,768,938 | A | * | 9/1988 | Greeson | 425/62 |
| 4,903,448 | A | * | 2/1990 | Compton | 52/252 |
| 4,945,695 | A | * | 8/1990 | Majurinen | 52/252 |

(Continued)

OTHER PUBLICATIONS

Mandrikov, Concrete Members Design Samples, 10 pages, 1979.

*Primary Examiner* — Robert Canfield
*Assistant Examiner* — Babajide Demuren
(74) *Attorney, Agent, or Firm* — Dorr, Carson & Birney, P.C.

(57) ABSTRACT

A building system uses modular precast concrete components that include a series of columns with wide, integral capitals. Wide beam slabs are suspended between adjacent column capitals by hangers. Joist slabs (e.g., rib slabs or other substantially planar components) can then be suspended between the beam slabs and column capitals to provide a floor surface.

17 Claims, 14 Drawing Sheets

U.S. PATENT DOCUMENTS 4,951,438 A * 8/1990 Thoresen ..... 52/252
5,061,111 A * 10/1991 Hosokawa ..... 403/232.1
5,390,464 A * 2/1995 West ..... 52/741.1
5,507,124 A * 4/1996 Tadros et al. ..... 52/251
5,660,020 A * 8/1997 Reay ..... 52/745.2
5,809,712 A * 9/1998 Simanjuntak ..... 52/223.7
6,073,401 A * 6/2000 Iri et al. ..... 52/79.1
6,151,851 A * 11/2000 Carter ..... 52/236.3
6,339,903 B1 * 1/2002 Zambelli et al. ..... 52/167.1
6,679,017 B2 * 1/2004 Woodruff et al. ..... 52/283
7,007,431 B2 3/2006 Schubert
7,028,435 B2 4/2006 Walker et al.

* cited by examiner

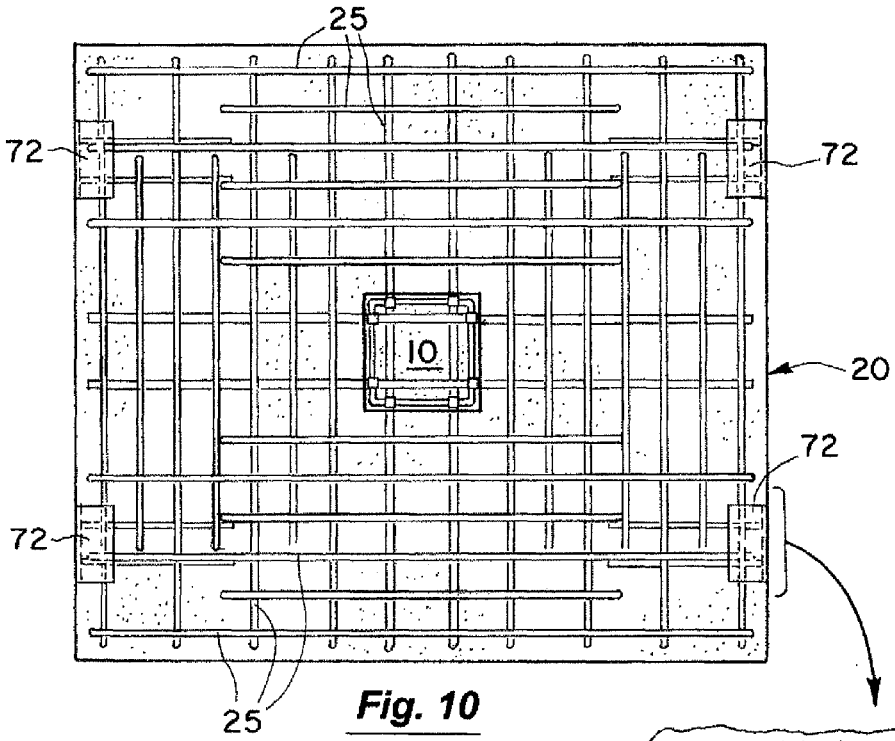
Fig. 10
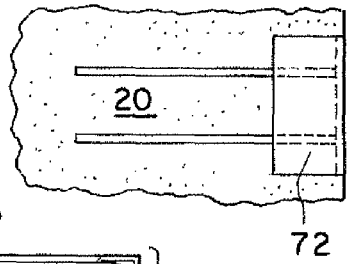
Fig. 10(a)
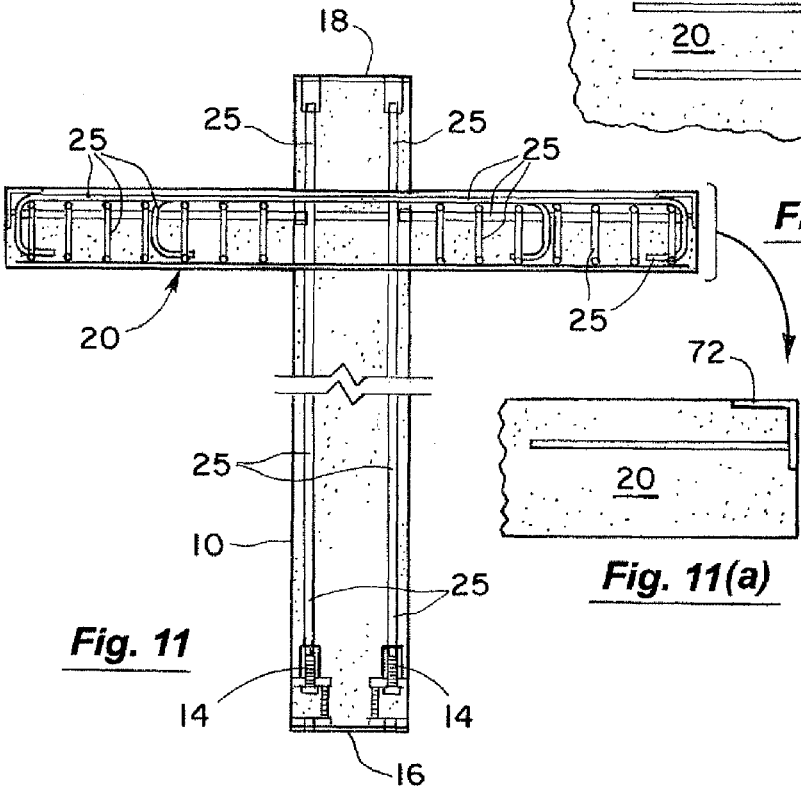
Fig. 11
Fig. 11(a)

BUILDING SYSTEM USING MODULAR PRECAST CONCRETE COMPONENTS

RELATED APPLICATION

The present application is based on and claims priority to the Applicant's U.S. Provisional Patent Application 60/843,799, entitled "Building System Using Modular Precast Concrete Components," filed on Sep. 11, 2006.

BACKGROUND OF THE INVENTION

Field of the Invention

The present invention relates generally to the field of building construction using precast concrete components. More specifically, the present invention discloses a building system using modular precast concrete components that facilitates longer spans between columns and shallower flooring assemblies.

Statement of the Problem

Most high-rise building construction currently uses structural steel or cast-in-place post-tensioned building systems. Except for providing hollow-core framing elements supported by walls or steel beams, prestress concrete manufacturers have been largely unsuccessful in competing with post-tensioned cast-in-place structural framing systems for providing a total framing solution.

Examples of conventional precast framing are shown in FIGS. 1 through 4(*a*). As shown in the perspective view provided in FIG. 1, inverted tee beams 130 typically bear on corbels 110 attached to the columns 10. Double-T floor slabs 140 are then placed at intervals between the inverted tee beams 130 to create a floor surface. FIG. 2 is a cross-sectional view taken along a horizontal plane showing another example of conventional precast framing. For example, double-tee beams 140 are often used as floor slabs, as shown in these figures. FIG. 3 is a vertical cross-sectional view corresponding to FIG. 2. FIG. 3*a* is a detail vertical cross-sectional view of conventional precast framing showing the assembly of an inverted T-beam 130 on a column corbel 110, and two double-T beams 140. FIG. 4 is a vertical cross-sectional view corresponding to FIG. 2 taken along a vertical plane orthogonal to FIG. 3, and FIG. 4*a* is a detail vertical cross-sectional view perpendicular to FIG. 3*a*. Any of a variety of conventional erection connectors 170 can be employed to secure the structural components to one another.

There are several disadvantages associated with conventional precast framing systems in this type of construction. Probably the most important advantage that cast-in-place construction has over conventional precast construction is moment continuity at the column lines. Typical prestressed concrete construction uses discrete joist and beam elements that are simply supported at their ends and have little moment continuity to their neighboring elements. In contrast, cast-in-place structures behave in a more redundant and complex manner since they are formed and cast monolithically. Continuous structures, such as cast-in-place floor systems, tend to be stiffer and stronger than precast structures for the same member thickness.

One response to this limitation is to increase the depth of precast beam elements to increase their strength. However, this tends to result in precast beam elements that are deeper than what architects and owners typically specify. In particular, increasing the depth of precast beam elements increases the resulting floor depth of the assembly beyond desirable limits.

In addition, precast inverted tee beams and ell-beams are relatively economical when they remain on orthogonal column grids, but they are not well suited for cantilever spans, such as balconies. Furthermore, even if precast beams could be made shallower, conventional precast construction uses column corbels 110 (shown for example in FIG. 1) that extend downward below the bottom of the inverted tee beam 130 and encroach on ceiling clearance.

Therefore, a need exists for a building system that enables modular precast components to be used in longer spans between columns, and allows reduction in floor assembly thickness.

Solution to the Problem

The present invention addresses the shortcomings of prior art precast building systems by using columns with wide capitals. The wide capitals, in turn, support wide beam slabs suspended between adjacent capitals. Instead of increasing beam strength by adding depth, the present invention makes the flexural members wider. It should be noted that this is not a simple substitution of one dimension for another, due to the problem of stability. Conventional narrow inverted-tee and ell-beams can easily be supported to prevent the beam from rolling off the supporting column or corbel. However, wide beam elements are inherently unstable. The present invention addresses the stability issue by using wide column capitals to support the wide beam slabs.

In addition to increasing the strength of the beam elements, the use of wide beam slabs decreases the depth of the floor assembly to dimensions similar to those available with other construction techniques. The use of wide column capitals also reduces the required length of the beam slabs and other components for a given column grid spacing.

Finally, the present invention tends to reduce camber and results in flatter floors. Prestress concrete floor members are typically made stronger by adding prestressed strands. Long spans and highly prestressed concrete beam and joist members tend to camber upward as a result of the eccentricity of the prestress forces relative to the member cross-section. This causes the floor to be higher near the middle of bays. In contrast, the present invention reduces camber by using shorter spans and shallower beam elements that require fewer prestressed strands and results in flatter floors.

SUMMARY OF THE INVENTION

This invention provides a building system using modular precast concrete components. A series of columns are equipped with wide, integral capitals. Wide beam slabs are suspended between adjacent column capitals by hangers. Joist slabs (e.g., rib slabs or other substantially planar components) can then be suspended between the beam slabs and column capitals to provide a floor surface.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 10 is a horizontal cross-sectional view of the column 10 and capital 20 showing reinforcement.

FIG. 10*a* is a detail horizontal cross-sectional view of the bearing plate 72 on the capital 20 in FIG. 10.

FIG. 11 is a vertical cross-sectional view of the column 10 and capital 20.

FIG. 11*a* is a detail vertical cross-sectional view of the bearing plate 72 on the capital 20 in FIG. 11.

DETAILED DESCRIPTION OF THE INVENTION

Figure 1:
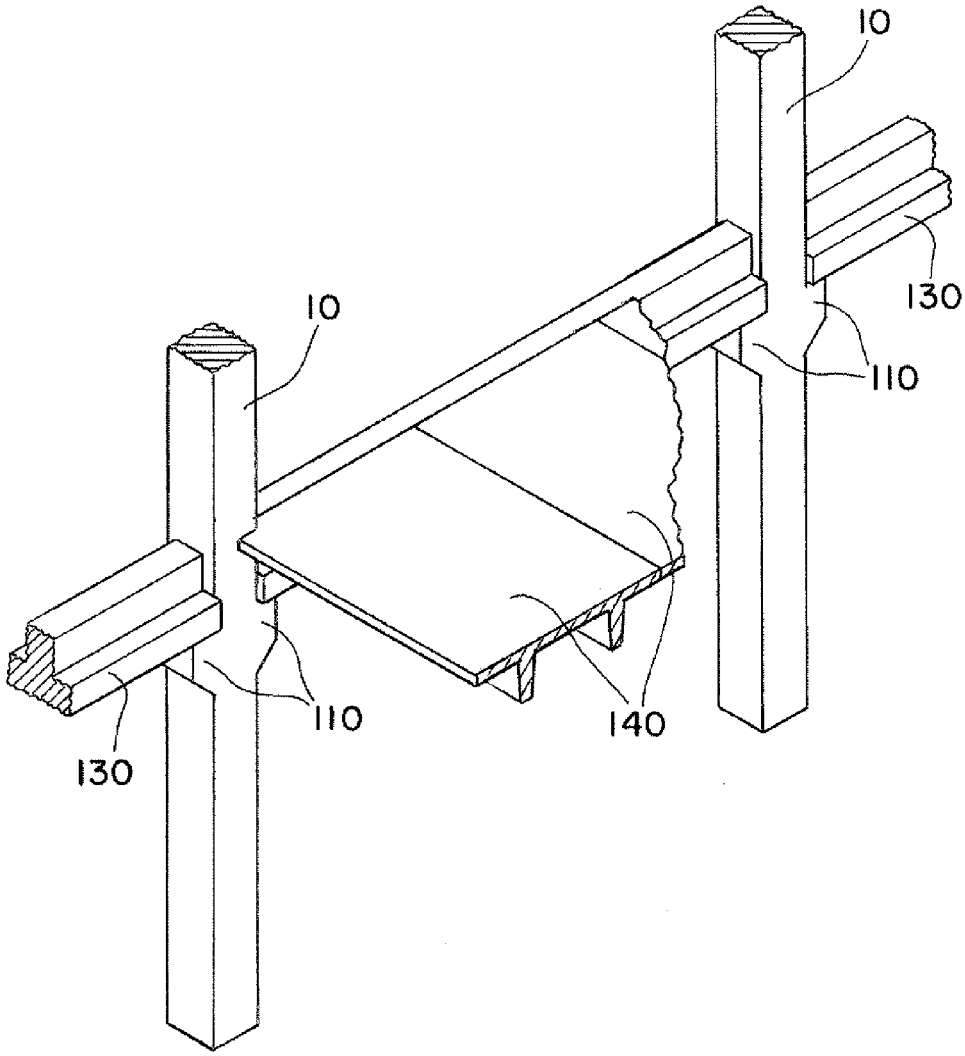
Fig. 1 ( Prior Art )
FIG. 1 is a perspective view showing an example of conventional building framing with precast concrete components.
Figure 2:
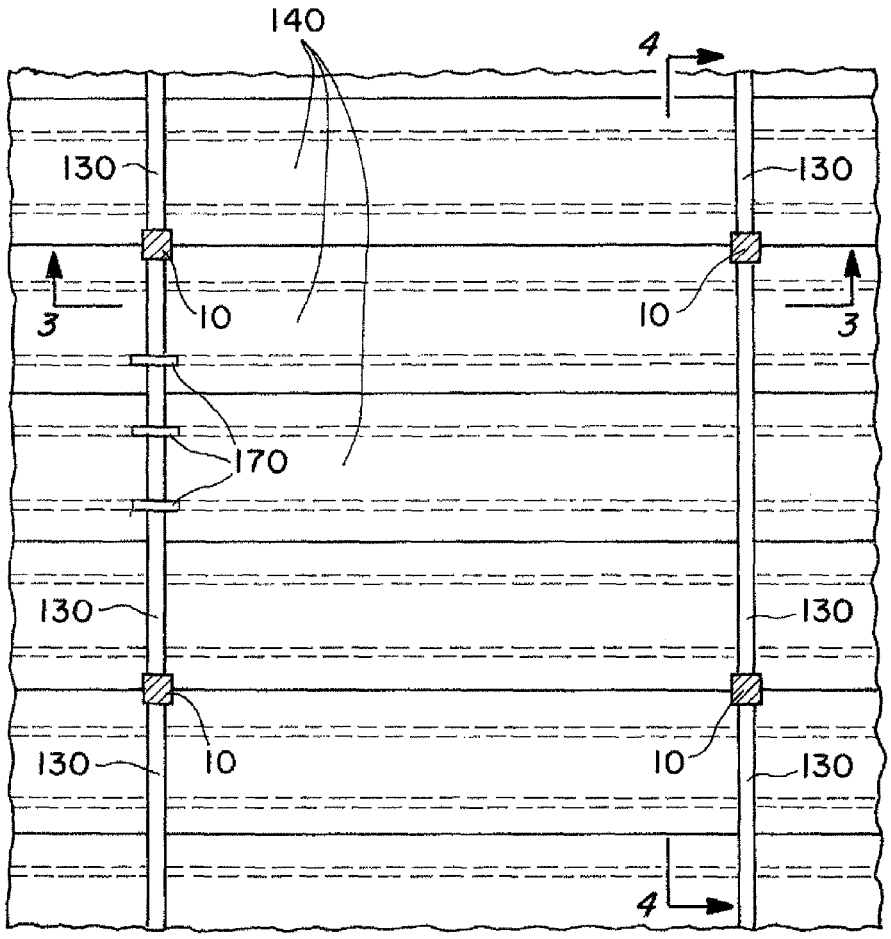
Fig. 2 ( Prior Art )
FIG. 2 is a cross-sectional view taken along a horizontal plane showing an example of conventional building framing with precast concrete components.
Figure 3:
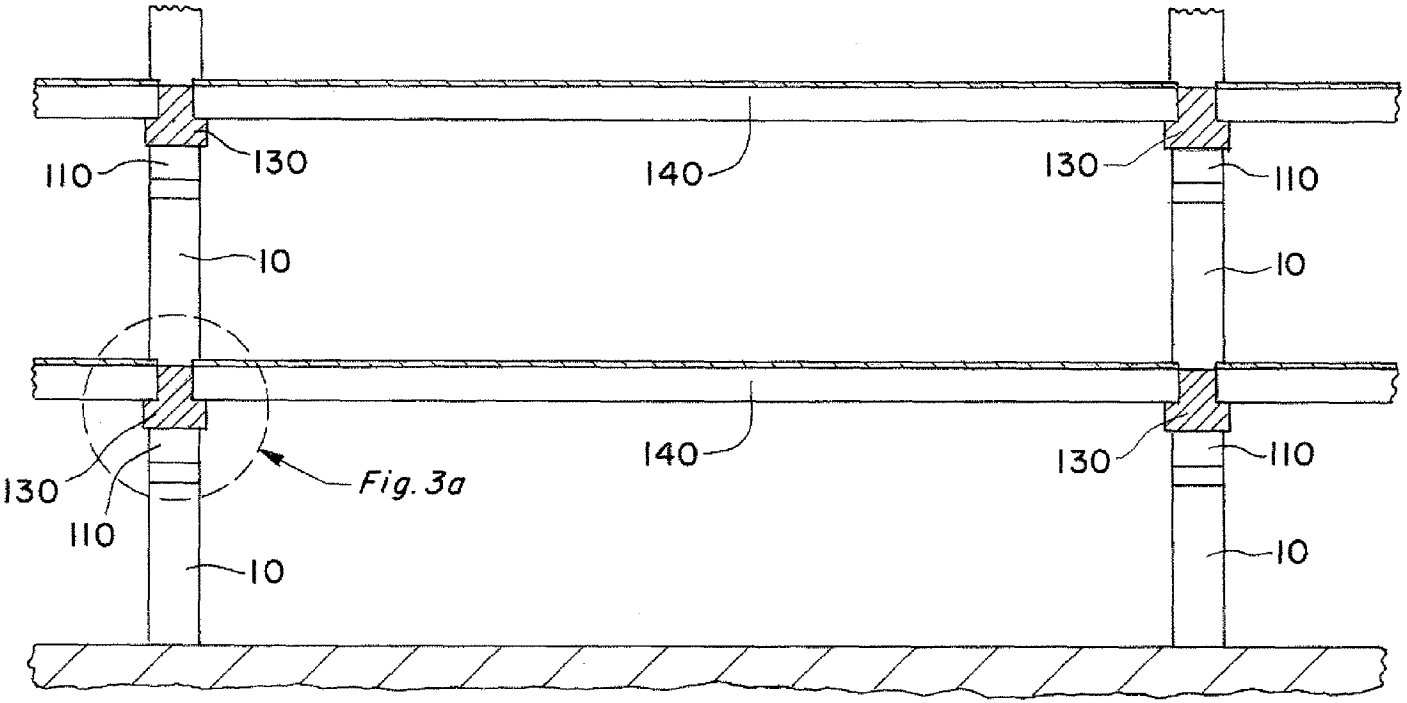
Fig. 3 (Prior Art)
FIG. 3 is a vertical cross-sectional view corresponding to FIG. 2.
Figure 3A:
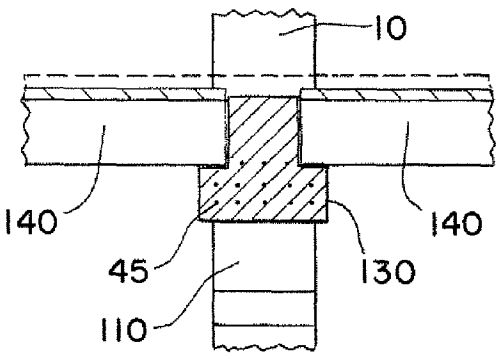
Fig. 3(a) (Prior Art)
FIG. 3*a* is a detail vertical cross-sectional view of conventional precast framing showing the assembly of an inverted T-beam on a column corbel, and two double-T beams.
Figure 4:
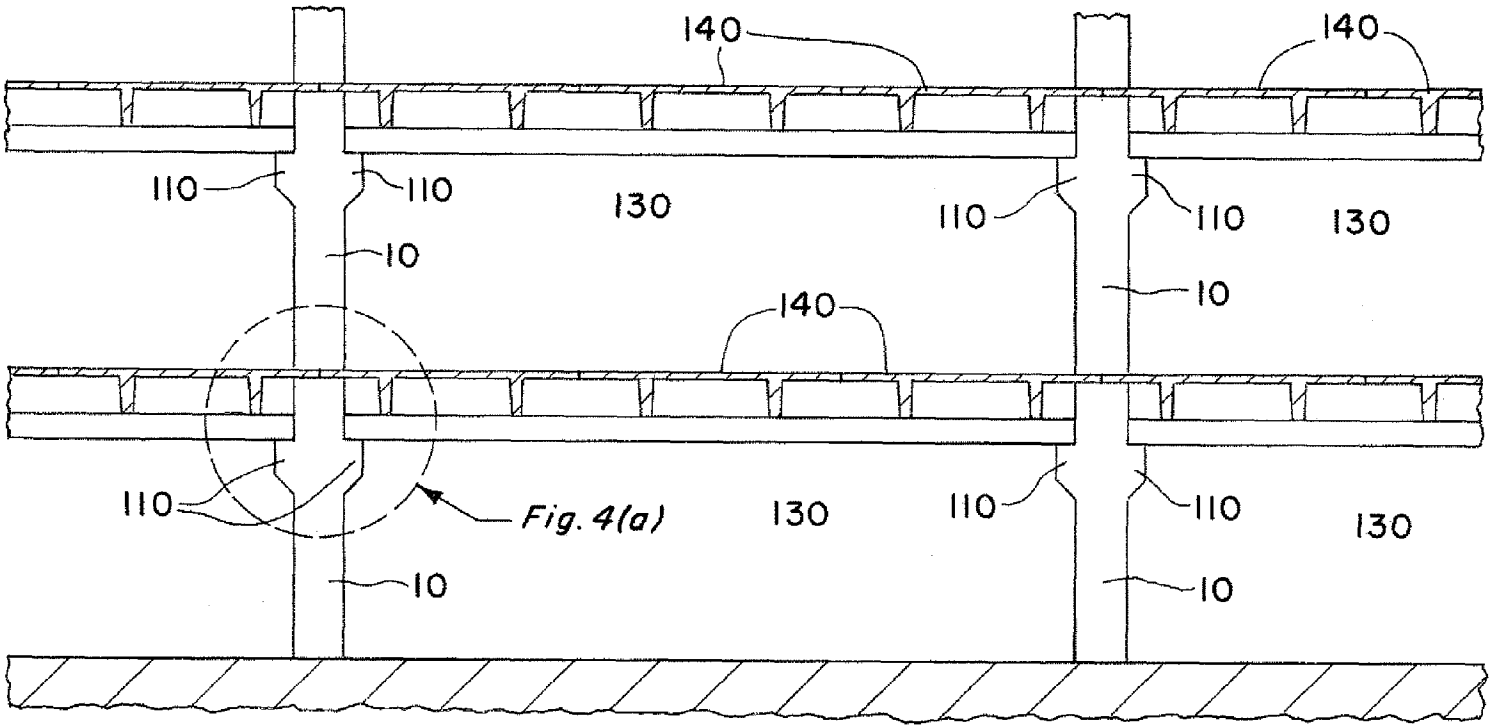
Fig. 4 (Prior Art)
FIG. 4 is a vertical cross-sectional view corresponding to FIG. 2 taken along a vertical plane orthogonal to FIG. 3.
Figure 4A:
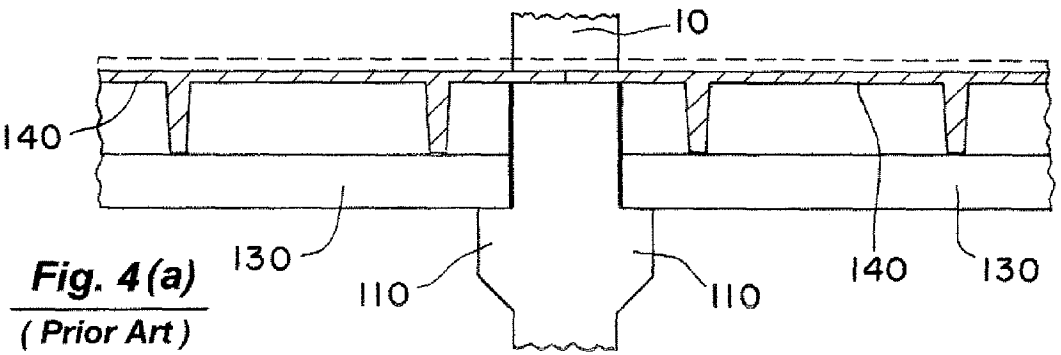
Fig. 4(a) (Prior Art)
FIG. 4*a* is a detail vertical cross-sectional view perpendicular to FIG. 3*a*.
Figure 5:
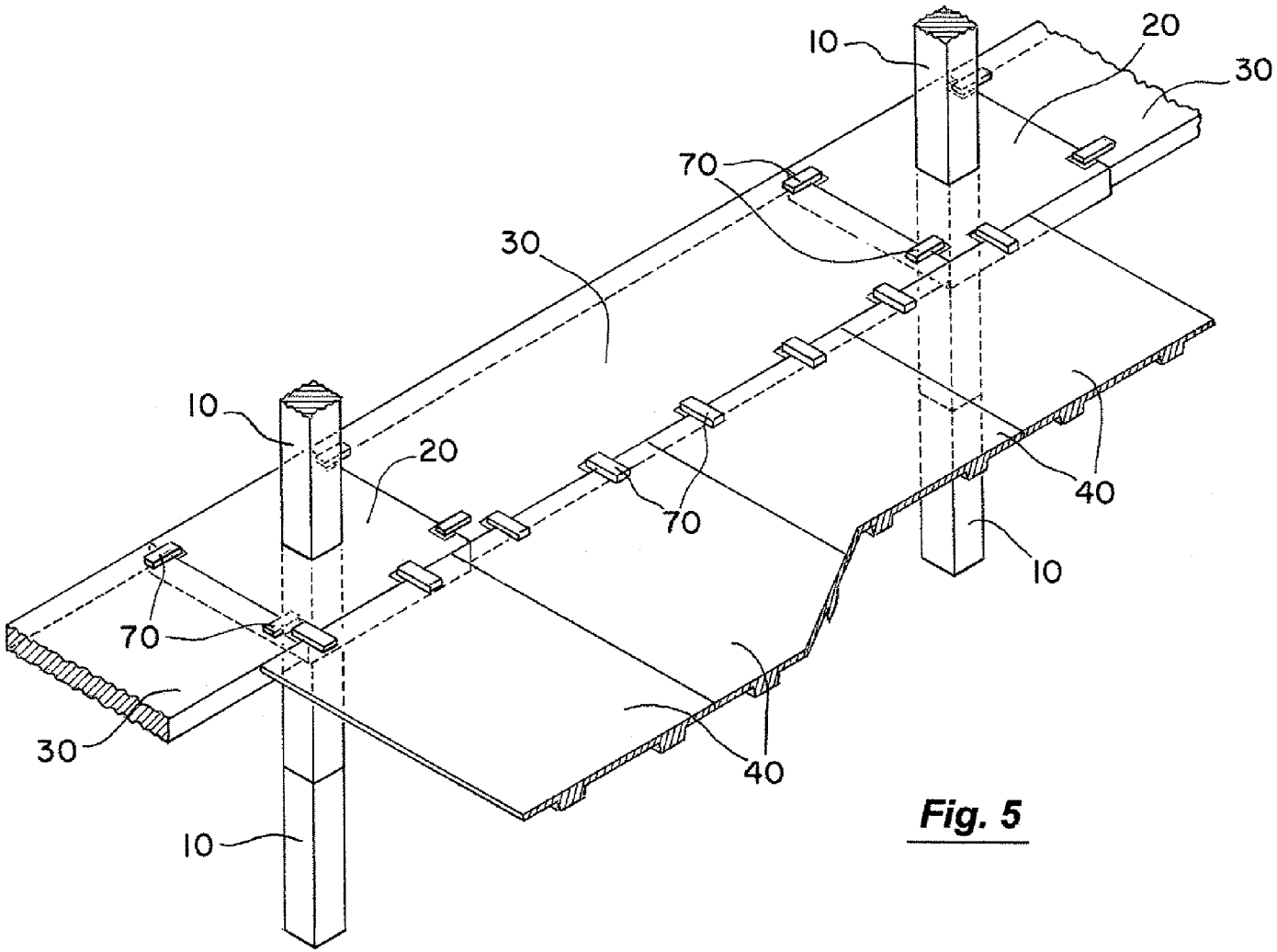
FIG. 5 is a perspective view showing an example of building framing using components in the present invention.
Figure 6:
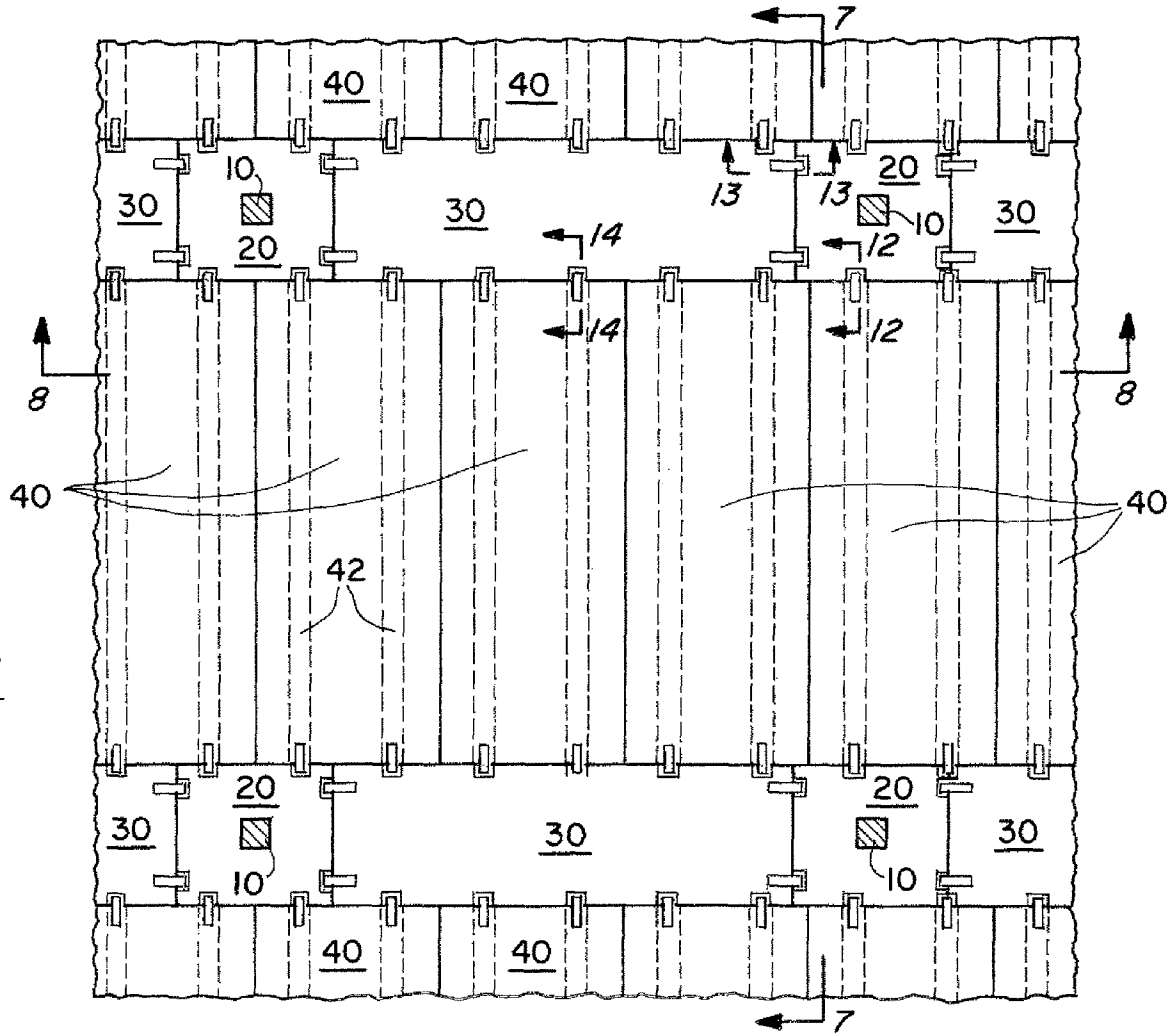
FIG. 6 is a cross-sectional view taken along a horizontal plane showing an example of building framing with components in the present invention.
Figure 7:
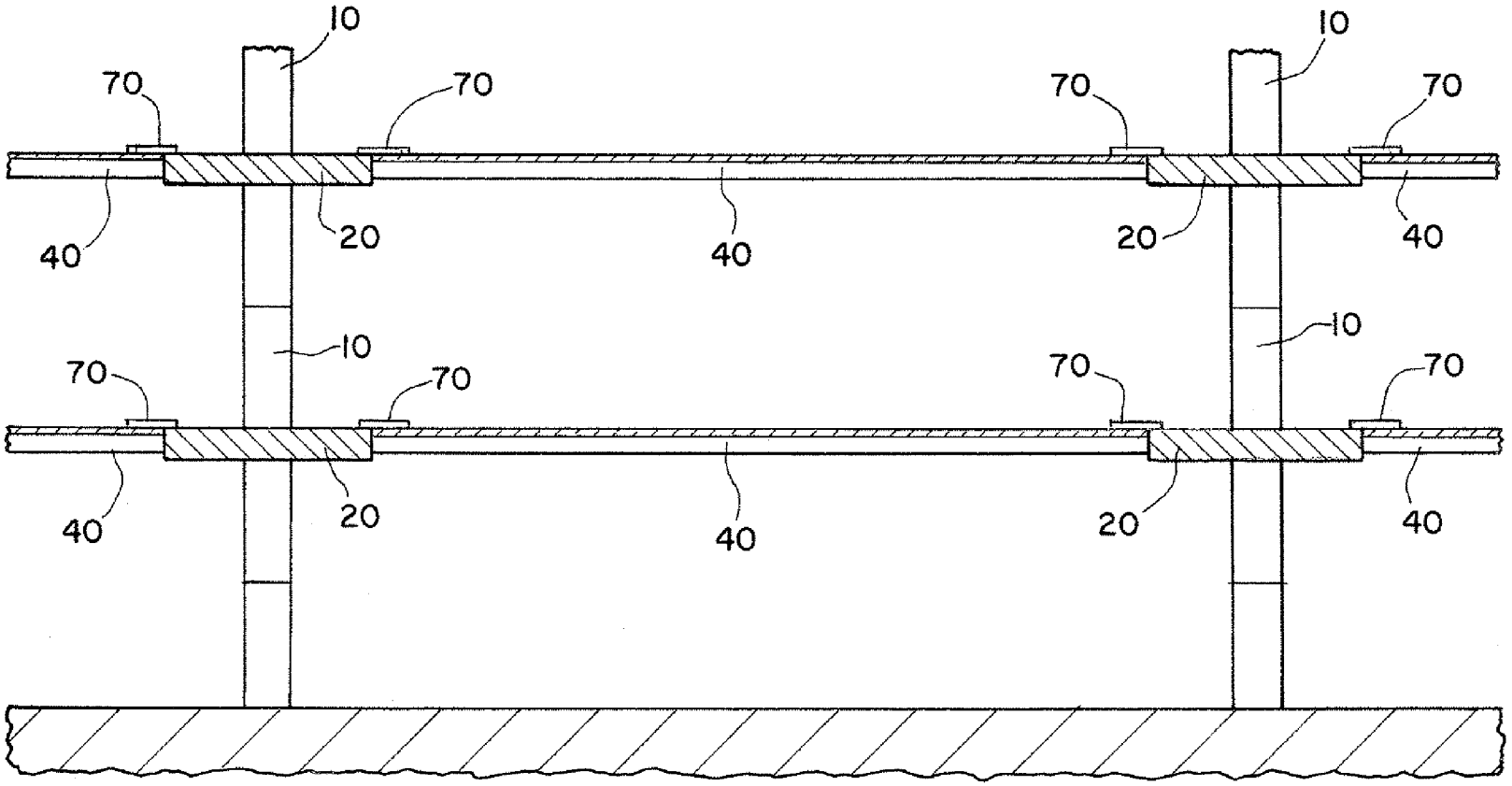
FIG. 7 is a vertical cross-sectional view corresponding to FIG. 6.
Figure 8:
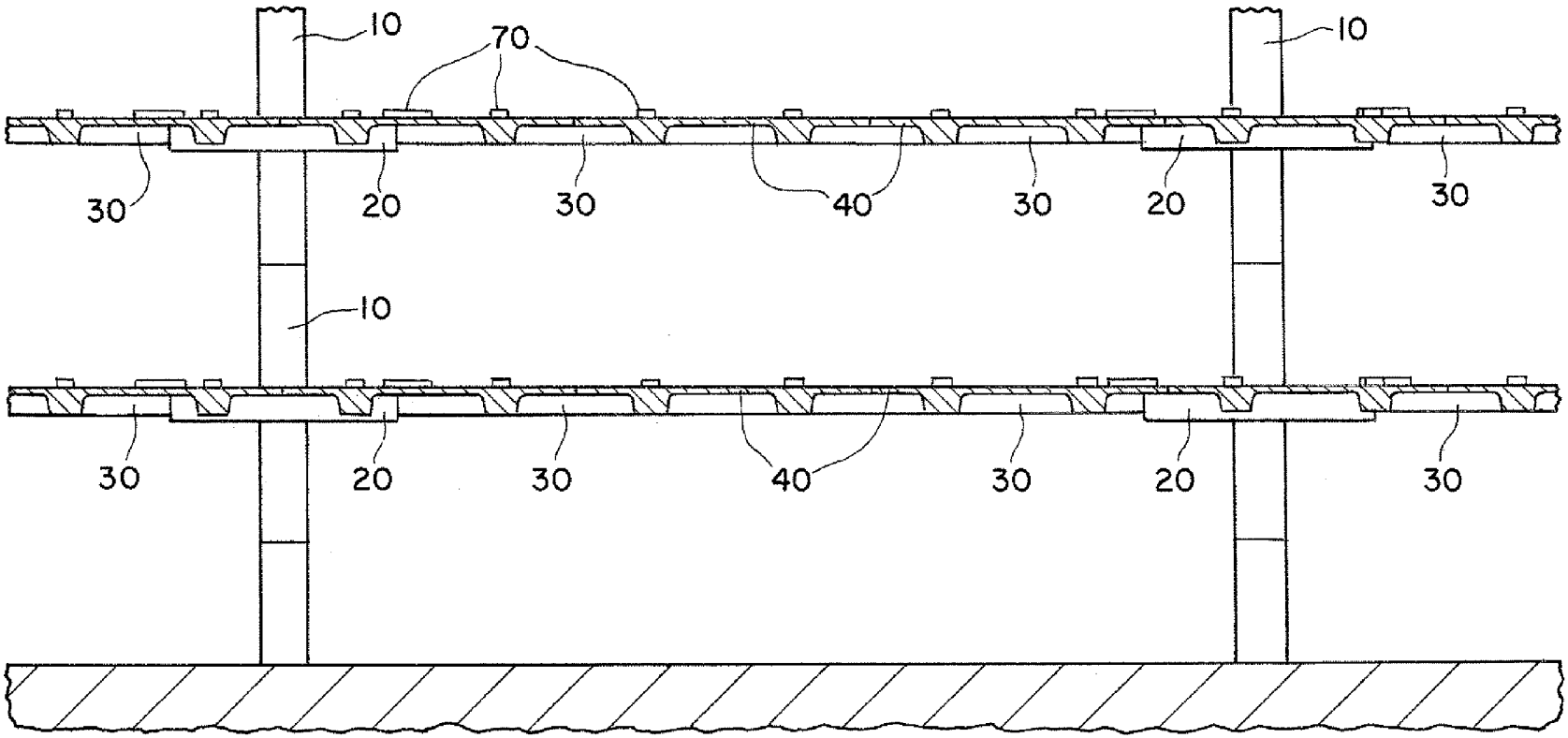
FIG. 8 is a vertical cross-sectional view corresponding to FIG. 6 taken along a vertical plane orthogonal to FIG. 7.

Turning to FIG. 5, a perspective view is provided showing an example of building framing using modular precast concrete components in the present invention. FIG. 6 is a cross-sectional view taken along a horizontal plane showing another example of building framing with components in the present invention. FIG. 7 is a vertical cross-sectional view corresponding to FIG. 6, and FIG. 8 is a vertical cross-sectional view corresponding to FIG. 6 taken along a vertical plane orthogonal to FIG. 7.

One major component of the present invention is a series of vertical columns 10 with wide capitals 20. The columns 10 can be made of precast concrete containing prestressed strands or rebar 15. On the construction site, the columns 10 are typically arranged in a grid pattern on the building foundation or stacked atop the columns of the floor below. Grid spacings of up to 30 feet are common in the construction industry, although the present invention could readily support grid spacings of 40 to 50 feet or more. The columns 10 can be equipped with end plates 16, 18 and couplers 14 to facilitate vertical stacking of the columns, as shown in the cross-sectional view provided in FIG. 11. Typical dimensions for a column are approximately 10 to 14 feet in height, and approximately 18 to 36 inches in width for most multi-story construction.

Figure 9:
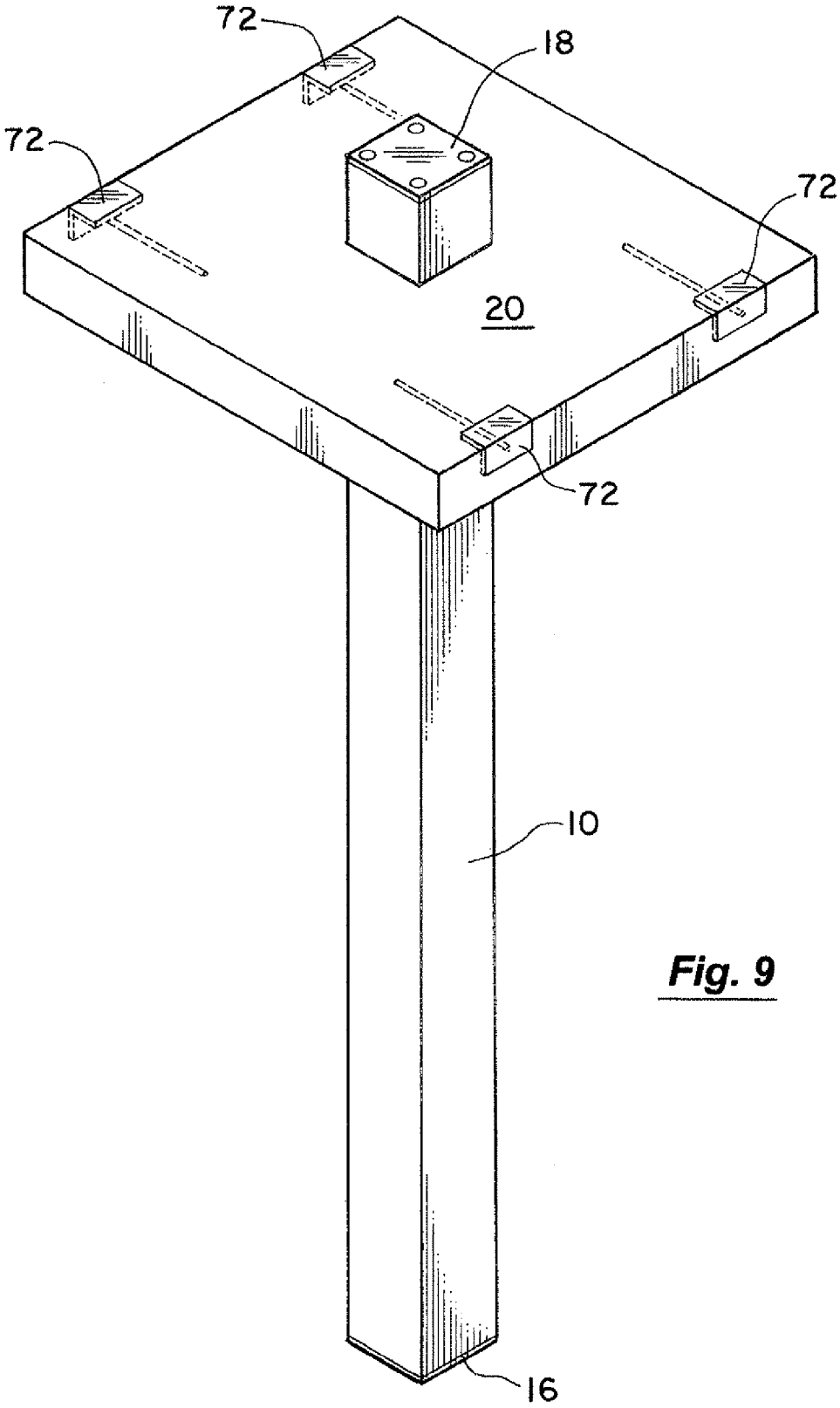
FIG. 9 is a perspective view of a column 10 and capital 20.

The capital 20 is preferably cast as an integral part of the column 10 as depicted in FIGS. 9-11. Here again, rebar or prestressed strands 25 can be used for reinforcement. This is shown in the cross-sectional views provided in FIGS. 10 and 11. For example, the dimensions of the capital can be approximately 10 to 24 inches in thickness, and approximately 4 to 12 feet in lateral extent depending on the structural requirements of the job and the dimensions of the other modular components. The capital 20 would usually have a generally rectangular cross-section, as shown for example in FIGS. 6, 9 and 10, although the capital could have any desired quadrilateral or polygonal shape. The column 10 can be centered in the capital 20 or it can be positioned off-center.

A column capital 20 is typically a projecting slab-type attachment to a column 10 that is cast integrally or mounted after the column 10 is cast. Its purpose is to provide torsion stability of wide beam elements (e.g., beam slabs, as will be discussed below) and/or to decrease the span length of the beam elements it supports. Column capitals 20 exhibit both shear and flexural behavior and have top tension stresses in all directions. In contrast, conventional column attachments (e.g., corbels) are very short projecting elements designed by shear friction methods that do not provide torsion beam stability and do not significantly shorten beam spans.

After the columns 10 have been erected, beam slabs 30 are suspended between adjacent column capitals 20 as shown in FIGS. 5 and 6. This results in a plurality of parallel runs of alternating capitals 20 and beam slabs 30. For example, two of these parallel runs are shown in FIG. 6. Alternatively, four beam slabs 30 could be suspended from each column capital 20 to create a two-dimensional grid. In its simplest embodiment, the beam slab can be a plain rectangular concrete slab with opposing ends and opposing lateral sides. Each beam slab 30 typically has about the same width as its abutting column capitals 20 (e.g., about 4 to 12 feet). Optionally, the beams slab 30 can be ribbed or incorporate voids, and can include prestressed strands or rebar 45.

Figure 12:
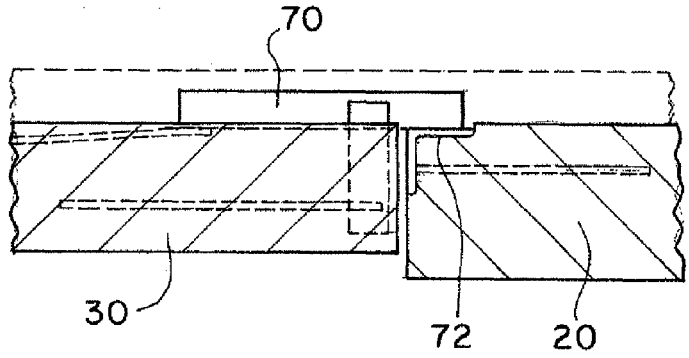
FIG. 12 is a detail vertical cross-sectional view of the end of a beam slab 30 with a hanger 70 supported by a bearing plate 72 on a capital 20.

As shown in FIG. 12, hangers 70 extending from the ends on the top surfaces of the beam slabs 30 allow the beam slabs 30 to be dropped into place between adjacent capitals 20. These hangers 70 contact the upper surfaces of the column capitals 20 to suspend and support the beam slabs 30 from the column capitals 20. In the preferred embodiment, four hangers 70 are mounted in each beam slab 30. For example, Cazaly hangers, Loov hangers or any of a variety of other types of hangers could be used. Optionally these hangers 70 can contact corresponding bearing plates 72 on the top edges of the column capitals 20. FIGS. 10(*a*) and 11(*a*) show detail horizontal and vertical cross-sectional views of a bearing plate 72 on the top edge of a column capital 20. FIG. 12 is a detail vertical cross-sectional view of the end of a beam slab 30 with a hanger 70 supported by a bearing plate 72 on a capital 20. This use of hangers 70 allows drop-in assembly of these components.

Figure 13:
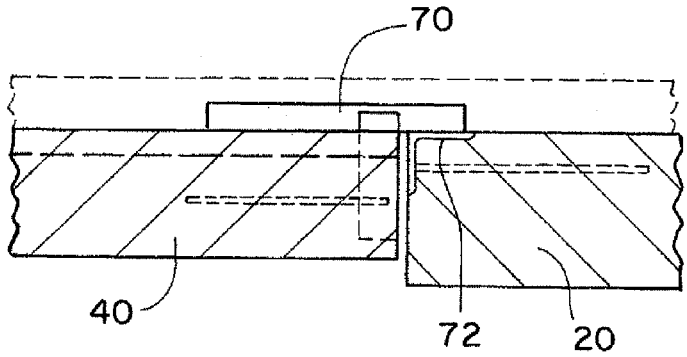
FIG. 13 is a detail vertical cross-sectional view of the end of a joist slab 40 with a hanger 70 supported by a bearing plate 72 on a capital 20.
Figure 14:
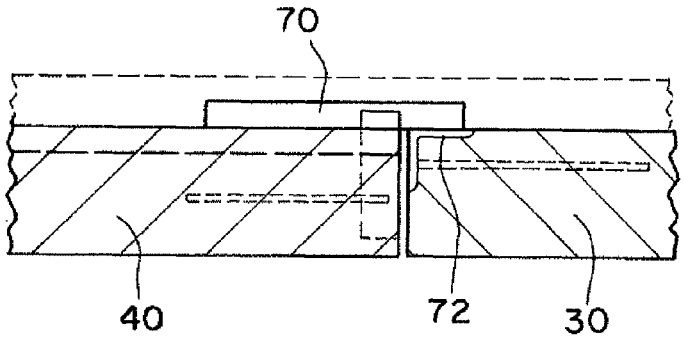
FIG. 14 is a detail vertical cross-sectional view of the end of a joist slab 40 with a hanger 70 supported by a bearing plate 72 on a beam slab 30.

After installation of the beam slabs 30, a number of joist slabs 40 can be dropped into place across the span between adjacent runs of column capitals 20 and beam slabs 30, as shown for example in FIG. 6, to create a desired floor structure. The joist slabs 40 can be precast concrete slabs having a generally rectangular shape with opposing ends and opposing lateral sides. The joist slabs 40 typically extend perpendicular to the beam slabs 30. Here again, hangers 70 extending from the ends of the joist slabs 40 can be used to suspend the joist slabs 40 between the beam slabs 30 and/or column capitals 20. FIG. 13 is a detail vertical cross-sectional view of the end of a joist slab 40 with a hanger 70 supported by a bearing plate 72 on a capital 20. FIG. 14 is a detail vertical cross-sectional view of the end of a joist slab 40 with a hanger 70 supported by a bearing plate 72 on a beam slab 30. The finished assembly can then be covered with a thin concrete topping (e.g., 4 inches of concrete) to create a relatively smooth floor surface.

Figure 15:
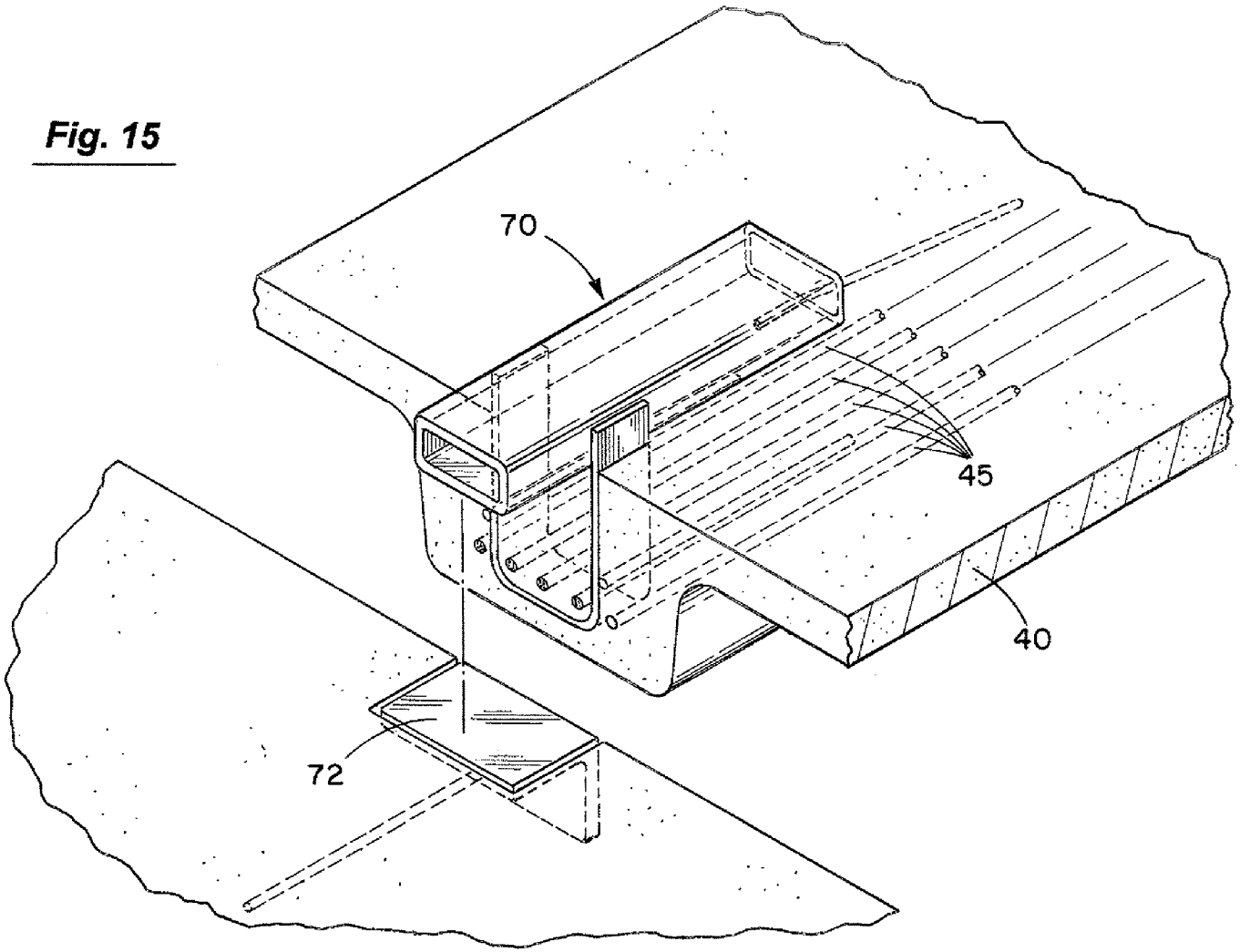
FIG. 15 is a detail perspective view of a hanger 70 and bearing plate 72.

In the embodiment shown in the accompanying drawings, the joist slabs 40 include shallow ribs 42 and prestressed strands 45 running between the opposing ends of the joist slab 40 for added strength, as shown for example in the detail perspective view provided in FIG. 15. These can be referred to as "rib slabs." Alternatively, the joist slabs 40 could be simple concrete slabs, hollow-core panels, or any type of substantially planar member. Architects are more frequently objecting to ribbed floor members, so flat-bottomed elements could be used as the joist slab and beam slab elements. A more economical dry-cast or extruded hollow-core element could be used as an alternative to the shallow ribs 42 of the joist slabs 40. However, rib slabs may be more suitable for parking garages and similar structures since they can be warped for drainage and do not have voids that can fill with water and freeze.

Figure 16:
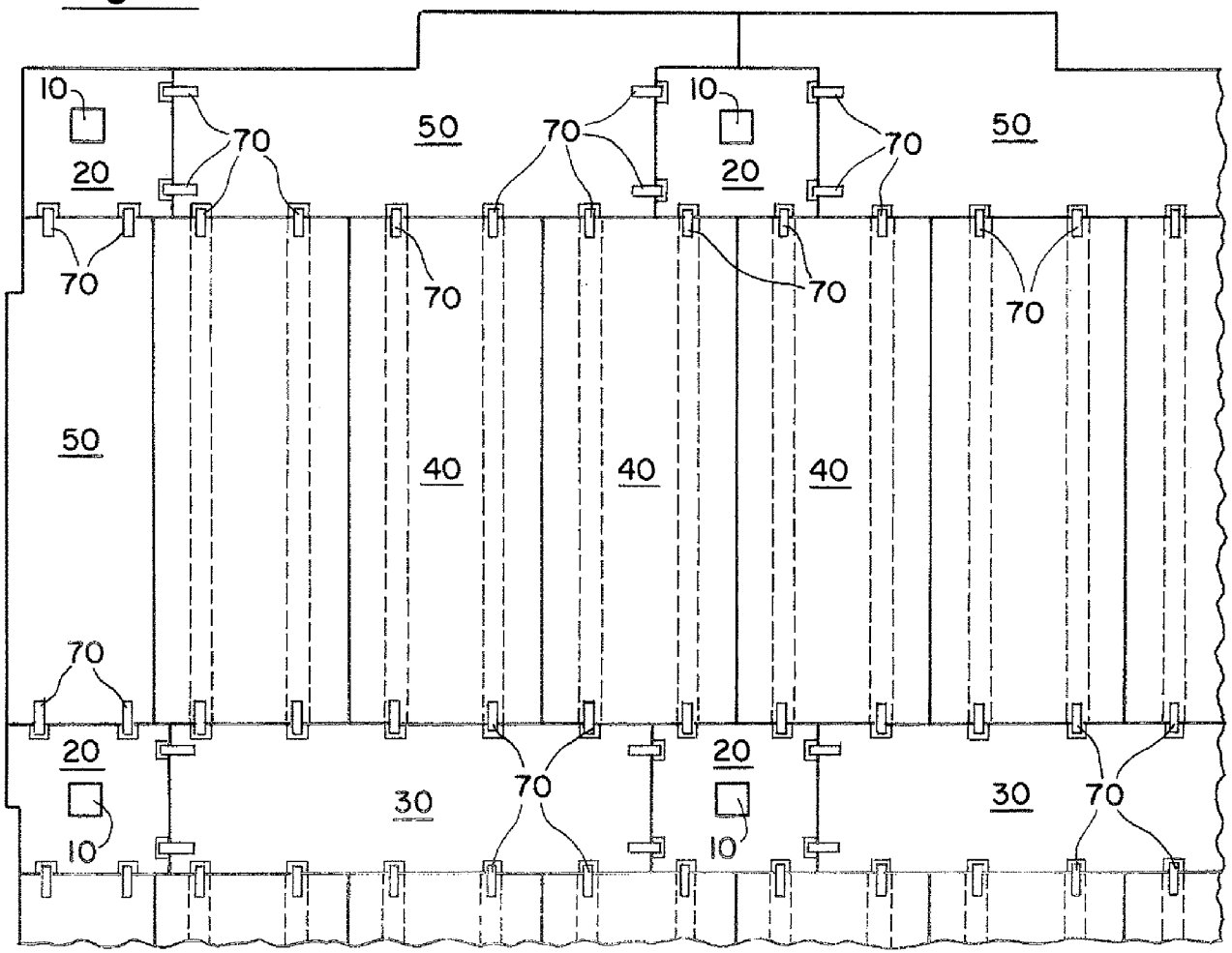
FIG. 16 is a top view of an assembly of components including a number of custom-formed capitals 20 and balcony slabs 50.

Cantilever spans and balconies are difficult to frame using conventional precast framing. In order to frame cantilevers using conventional framing, rectangular beams or soffit beams must be used. Rectangular beams are not as strong as inverted-tee beams since they are not as deep and do not connect into the structural topping slab. Rectangular and soffit beams also support cantilevered slabs from below and are not suitable for a shallow floor system. In contrast, the column capitals in the present invention allow flat slabs and beam slabs to be cantilevered without increasing structure depth. FIG. 16 is a top view of an assembly that includes balcony slabs 50, custom-formed capitals 20 and other irregularly-shaped components. The modular nature of the present invention permits such components to be readily incorporated into a building design. It should also be noted that the columns capitals 20, beam slabs 30 and joist slabs 40 can include mechanical pass-throughs required for plumbing, electrical wiring, etc.

In light of preceding discussions, it should be understood that the present invention provides a number of the advantages including reduced floor thickness while matching the conventional 30-foot column grid spacing for cast-in-place concrete construction techniques. Column spacings of up to 40 feet are possible with a 16 inch deep structural system, and 50 feet column spaces are possible with a 24 inch deep system.

The use of wider beam slabs 30 and capitals 20 also reduces the free-span to be bridged by the joist slabs 40, which allows lighter, thinner joist slabs to be used for a given column grid spacing. Alternatively, the joist slabs 40 can be used to span larger distances and permit greater column grid spacings. Similarly, the use of wider capitals 20 reduces the free-span for the beam slabs 30 for a given column grid spacing. Wide elements also offer greater horizontal restraint in case of fire.

Furthermore, the use of wide column capitals promotes the use of wide beam slabs, and together with hanging the entire structural system greatly simplifies detailing, production and erection by eliminating the need for corbels, ledges, bearing pads, stirrups, composite topping ties and special fire protection concerns associated with conventional precast construction techniques.

Another advantage of the present invention is that the beam elements are supported by hanger connections on their top surfaces, rather than bearing on corbels and ledges on the under surfaces. This allows layout flexibility for engineering. The structure is erected above the floor line on wider elements not having shear steel and topping rebar projections, which allows for safer and faster erection.

Figure 17:
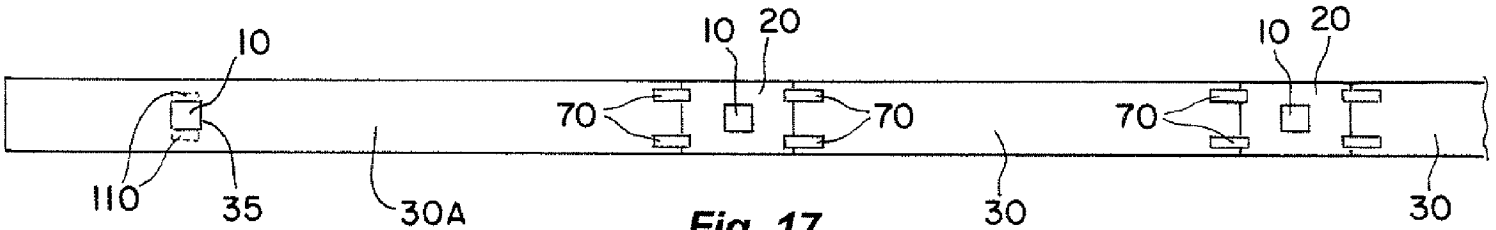
FIG. 17 is a top plan view of another embodiment with cantilevered beam slabs.
Figure 18:
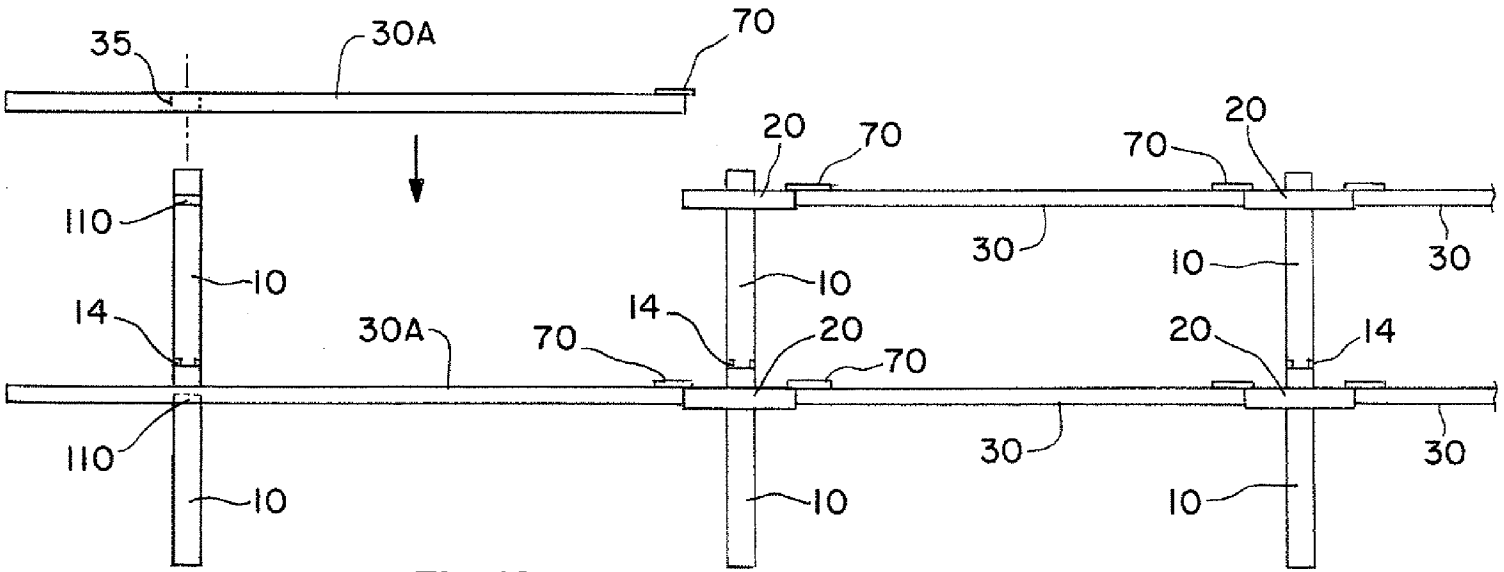
FIG. 18 is a side elevational view corresponding to FIG. 17.

FIG. 17 shows a top plan view and FIG. 18 shows a side elevational view of another embodiment with cantilevered beam slabs 30A. This approach allows extremely long cantilevers that frequently occur at the exterior edges of buildings. A hole 35 is formed in the cantilevered beam slab 30A that allows it to be lowered over the upper end of a column 10, so that the column 10 extends through the hole 35 in the beam slab 30A, as illustrated in FIG. 18. Corbels 110 on the column 10 engage the edges of the hole 35 and support the cantilevered portion of the beam slab 30A. The joint between the beam slab hole 35 and column 10 can be filled with grout. Backer rod can be placed in the joint prior to grouting to retain the wet grout. The corbels 110 can be made sufficiently small to be flush with the bottom surface of the beam slab 30A. The end of the beam slab 30 adjacent to the column capital 20 is also supported by the column capital 20 by a number of hangers 70, as previously discussed.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A building system comprising a plurality of modular precast concrete components including:

a plurality of precast concrete columns with wide shallow capitals having a width substantially greater than the width of the columns and a shallow thickness substantially less than the width of the capitals, said columns being spaced apart from one another in a predetermined pattern;

a plurality of wide shallow precast concrete beam slabs, each having opposing sides, opposing ends with a width substantially greater than the width of the columns extending across the width of a capital and a shallow thickness substantially less than the width of the beam slabs, and hangers extending from the ends for suspending and supporting the beam slabs between the capitals of adjacent columns; and a plurality of joist slabs supported between selected beam slabs and capitals to provide a floor surface.

2. The building system of claim 1 wherein at least one of the capitals has a width of approximately four to twelve feet.

3. The building system of claim 1 wherein at least one of the beam slabs has a width of approximately four to twelve feet.

4. The building system of claim 1 wherein the columns are arranged in a grid pattern and wherein a plurality of beam slabs are suspended between the columns in parallel runs.

5. The building system of claim 1 wherein the columns are arranged in a grid pattern and wherein a plurality of beam slabs are suspended between the columns in a grid pattern.

6. The building system of claim 1 wherein at least one hanger comprises a Cazaly hanger.

7. The building system of claim 1 wherein at least one hanger comprises a Loov hanger.

8. The building system of claim 1 wherein at least one joist slab further comprises hangers extending from opposing ends of the joist slab for suspending and supporting the joist slab between selected beam slabs and capitals.

9. The building system of claim 1 wherein the capital of at least one column further comprises a bearing plate to contact and support a hanger on a beam slab.

10. A building system comprising a plurality of modular precast concrete components including:

a plurality of precast concrete columns with wide shallow capitals having a width substantially greater than the width of the columns and a shallow thickness substantially less than the width of the capitals, said columns being spaced apart from one another in a predetermined pattern;

a plurality of wide shallow precast concrete beam slabs, each having opposing sides, opposing ends with a width substantially greater than the width of the columns extending across the width of a capital and a shallow thickness substantially less than the width of the beam slabs, and hangers extending from the ends for suspending and supporting the beam slabs between the capitals of adjacent columns; and a plurality of rib slabs, each having opposing ends with shallow ribs running between the ends and hangers extending from the ends for suspending and supporting the rib slabs between selected beam slabs and capitals to provide a floor surface.

11. The building system of claim 10 wherein at least one of the capitals has a width of approximately four to twelve feet.

12. The building system of claim 10 wherein at least one of the beam slabs has a width of approximately four to twelve feet.

13. The building system of claim 10 wherein the columns are arranged in a grid pattern and wherein a plurality of beam slabs are suspended between the columns in parallel runs.

14. The building system of claim 10 wherein the columns are arranged in a grid pattern and wherein a plurality of beam slabs are suspended between the columns in a grid pattern.

15. The building system of claim 10 wherein at least one hanger comprises a Cazaly hanger.

16. The building system of claim 10 wherein at least one hanger comprises a Loov hanger.

17. The building system of claim 10 wherein the capital of at least one column further comprises a bearing plate to contact and support a hanger on a beam slab.

* * * * *

UNITED STATES PATENT AND TRADEMARK OFFICE

CERTIFICATE OF CORRECTION

PATENT NO. : 8,011,147 B2
APPLICATION NO. : 11/742030
DATED : September 6, 2011
INVENTOR(S) : John W. Hanlon It is certified that error appears in the above-identified patent and that said Letters Patent is hereby corrected as shown below:

Title page, item [76] inventor: John W. Hanlan should read -- John W. Hanlon --

Signed and Sealed this
Seventh Day of February, 2012

David J. Kappos

David J. Kappos
*Director of the United States Patent and Trademark Office*